US010605047B2

(12) United States Patent
Patel

(10) Patent No.: US 10,605,047 B2
(45) Date of Patent: Mar. 31, 2020

(54) MULTI-STAGE VALVE ACTUATOR

(71) Applicant: Schlumberger Technology Corporation, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 252 days.

(21) Appl. No.: 15/334,893

(22) Filed: Oct. 26, 2016

(65) Prior Publication Data

US 2017/0044869 A1 Feb. 16, 2017

Related U.S. Application Data

(62) Division of application No. 13/398,117, filed on Feb. 16, 2012, now Pat. No. 9,482,076.

(60) Provisional application No. 61/444,934, filed on Feb. 21, 2011.

(51) Int. Cl.

| | |
|---|---|
| ***E21B 34/10*** | (2006.01) |
| ***E21B 34/06*** | (2006.01) |
| ***E21B 34/08*** | (2006.01) |
| ***E21B 41/00*** | (2006.01) |

(52) U.S. Cl.

CPC ..... *E21B 34/10* (2013.01); *E21B 34/063* (2013.01); *E21B 34/066* (2013.01); *E21B 34/08* (2013.01); *E21B 41/0035* (2013.01)

(58) Field of Classification Search

CPC ..... E21B 34/06

See application file for complete search history.

(56) References Cited

U.S. PATENT DOCUMENTS

| | | | | |
|---|---|---|---|---|
| 4,694,903 | A | 9/1987 | Riggenberg | |
| 4,796,705 | A * | 1/1989 | Carmody | E21B 34/102 166/321 |
| 4,951,753 | A | 8/1990 | Eriksen | |
| 4,979,568 | A | 12/1990 | Spencer, III et al. | |
| 5,819,854 | A | 10/1998 | Doane et al. | |
| 6,125,930 | A | 10/2000 | Moyes | |
| 6,148,920 | A * | 11/2000 | McCalvin | E21B 34/06 166/324 |
| 6,619,388 | B2 | 9/2003 | Dietz et al. | |
| 7,108,073 | B2 | 9/2006 | Patel | |
| 7,703,532 | B2 | 4/2010 | O'Malley et al. | |
| 7,828,065 | B2 | 11/2010 | Ross et al. | |
| 7,832,489 | B2 | 11/2010 | Assal | |
| 7,866,402 | B2 | 1/2011 | Williamson, Jr. | |
| 7,926,573 | B2 | 4/2011 | Swan et al. | |
| 7,934,553 | B2 | 5/2011 | Malone | |

(Continued)

FOREIGN PATENT DOCUMENTS

| | | | |
|---|---|---|---|
| WO | 2010117659 | A1 | 10/2010 |
| WO | 2010123588 | A1 | 10/2010 |

*Primary Examiner* — Robert E Fuller

(57) ABSTRACT

An actuator assembly for effective interventionless activation of a valve in wells of multilateral architecture. The assembly may be pressure actuated from an oilfield surface even in certain circumstances where another valve in another leg of the well has been opened in a manner compromising pressure control of the well. Due to the multi-stage nature of the actuator, pressure based activation remains viable as a result of supplemental and/or fail-safe modes of actuation, for example, where such pressure control becomes compromised.

9 Claims, 8 Drawing Sheets

(56) References Cited

U.S. PATENT DOCUMENTS

| | | | |
|---|---|---|---|
| 7,967,071 | B2 | 6/2011 | Brown |
| 8,096,363 | B2 | 1/2012 | Williamson, Jr. |
| 8,157,022 | B2 | 4/2012 | Bertoja et al. |
| 8,251,150 | B2 | 8/2012 | Ross |
| 2008/0223585 | A1 | 9/2008 | Patel et al. |

* cited by examiner

MULTI-STAGE VALVE ACTUATOR

PRIORITY CLAIM/CROSS REFERENCE TO RELATED APPLICATION(S)

This divisional patent application claims the benefit of priority to co-pending U.S. patent application Ser. No. 13/398,117, filed Feb. 16, 2012 and entitled "Multi-Stage Valve Actuator", which is incorporated herein by reference in its entirety, and in turn claims priority to U.S. Provisional App. Ser. No. 61/444,934, filed on Feb. 21, 2011, and entitled, "Isolation Device for Multi-Lateral with Dual Trip Saver", incorporated herein by reference in its entirety.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Over the years, ever increasing well depths and sophisticated architecture have made reductions in time and effort spent in completions and maintenance operations of even greater focus.

In terms of architecture, the terminal end of a cased well often extends into an open-hole lateral leg section. In many cases, multiple leg sections of this nature extend from a single main vertical well bore. Such architecture may enhance access to the reservoir, for example, where the reservoir is substantially compartmentalized. Regardless, such open-hole lateral leg sections often present their own particular challenges when it comes to their completions and maintenance.

In terms of completions, a variety of hardware may be installed before the well and various legs are ready for production operations. That is, in addition to the noted casing, hardware supporting various zonal isolations or chemical injection lines may be installed. Additionally, perforating, fracturing, gravel packing and a host of other applications may be employed in completing the well and various leg sections.

With particular reference to the lateral legs and other open-hole regions, the noted gravel packing and other production related enhancements may rely on the presence of a formation isolation valve. That is, such a valve may be disposed at the interface of cased and open-hole well regions so as to ensure a separation between completion and production fluids. More specifically, comparatively heavier fluids utilized during completions may be prone to adversely affect the formation if allowed to freely flow to the production region. By the same token, production of lighter high pressure fluids into the main bore during hardware installations may adversely affect such operations. Therefore, formation isolation valves may be disposed in cased regions of the well near the interface of open-hole well regions.

Each lateral leg may be outfitted with a formation isolation valve that may be opened for gravel packing and other early stage leg applications. However, such valves may be subsequently closed to isolate the open-hole portion of the leg as other completions are carried out elsewhere in the well.

As indicated, closing the valve may avoid fluid loss during completions operations and also maintain well control in the sense of avoiding premature production of well fluids. This closure may be achieved in conjunction with removal of application tools from the open-hole region of the leg. So, for example, following a gravel packing application in a lateral leg, a shifting device incorporated into the gravel packing wash pipe may be used to close off the valve as the assembly is removed from the area. Thus, completion of the application and retrieval of the tool involved may be sufficient to close the formation isolation valve.

Unfortunately, once the well is completed and ready for production, re-opening the valve may be a bit more challenging. For example, a shifting tool may be re-introduced into the well and directed at each valve, one by one. Of course, depending on the depth and sophistication of the well architecture, this may eat up one to three days of time as well as a significant amount of footspace at the oilfield. Further, equipment costs in terms of up-rigging may also be incurred. For example, where the legs at issue are of a horizontal nature, coiled tubing operations may be required for delivery of the shifting tool. Once more, the interventional nature of shifting tool delivery inherently involves the possibility of mechanical failure and/or potential damage to the tool itself, particularly when considering the sudden emergence of high pressure conditions as each valve is sequentially opened.

In order to address the potentially costly drawbacks associated with interventional shifting tool delivery to re-open the valves, wireless, pressure based opening techniques have been developed. For example, each leg of the multi-lateral may be outfitted with a formation isolation valve that incorporates a pressure responsive actuator for opening the valve. Thus, sufficient pressure may be introduced into the well from the surface of the oilfield in order to trigger the actuators to open their respective valves and allow production to commence.

Unfortunately, in the described scenario, the actuators may not all open at precisely the same time. For example, the pressure increase may propagate unevenly or one actuator may be responsive to a slightly different pressure than another. When this occurs, the responsive actuators and associated open valves serve as an impediment to pressure actuation for any remaining un-open valves. That is, once one of the valves has been opened, continued efforts to pressure up the well and trigger other actuators are likely to only result in dumping fluid into the newly open-hole lateral leg. As a result, operators are then left with the only practical option being to resort to mechanical intervention in the form of a costly shifting tool application as noted above.

SUMMARY

A valve actuator is provided that includes multiple actuation mandrels. The first mandrel is configured for tension member release actuation upon exposure to a first pressure exceeding a predetermined level. The second mandrel is configured for rupture disc actuation upon exposure to a second pressure exceeding another predetermined level. Further, the second pressure is higher than the first pressure and the actuations provide valve opening capability to the mandrels. Thus, a method of utilizing the actuator may include introducing the first pressure to free the first mandrel from a body of the actuator followed by increasing the pressure to exceed the other predetermined level thereby shifting the second mandrel to open a valve coupled to the actuator. Subsequently, the pressure may be decreased to a level below the predetermined levels thereby allowing the freed first mandrel to move in the direction of the shifting.

DETAILED DESCRIPTION

Embodiments are described with reference to certain downhole assemblies that make use of a valve and valve actuator. In particular, production assemblies that are configured for disposal across cased and open-hole regions at various well locations are detailed. More specifically, multiple production assemblies simultaneously disposed in different legs of a multilateral well are detailed in conjunction with corresponding formation isolation valves. However, embodiments of a multi-stage valve actuator as detailed herein may be employed in conjunction with a variety of different types of downhole valves. For example, any number of valves or other actuations may be directed through such an actuator. Additionally, the actuator may be disposed in downhole environments that are not multilateral in nature. Regardless, the actuator is multi-stage in the sense that the introduction of one high pressure stage may be utilized to set a fail-safe mandrel release actuation in advance of introducing another high pressure stage for actuation of another mandrel. Thus, in circumstances where the other high pressure stage and mandrel fail to actuate the valve, the fail-safe mandrel may be released to ensure valve actuation.

Figure 1:
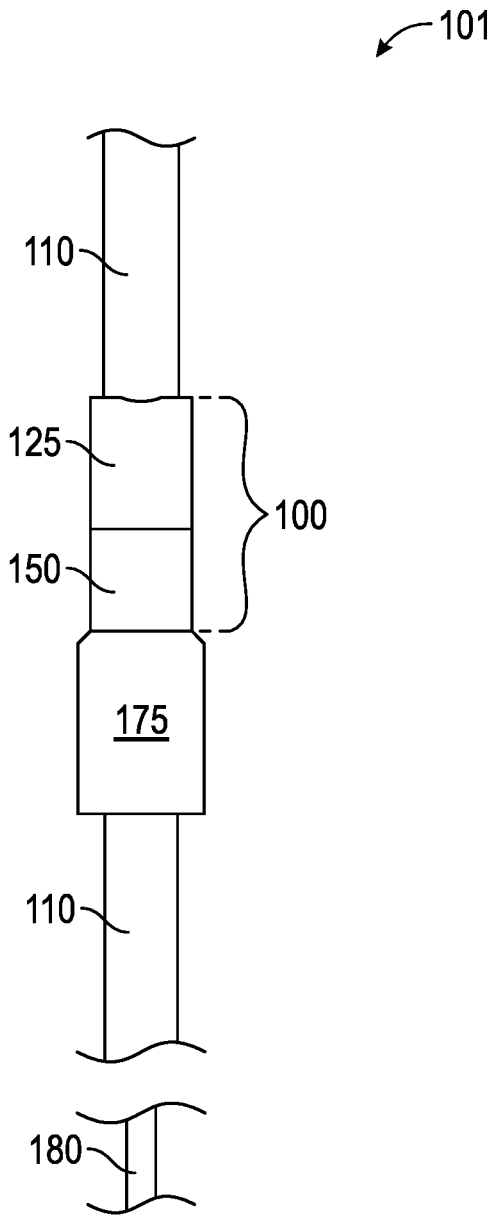
FIG. 1 is a front view of a downhole production assembly employing an embodiment of a multi-stage valve actuator.

Referring now to FIG. 1, a front view of a downhole production assembly 101 is shown which utilizes a multi-stage valve actuator 100 as referenced above. The assembly 101 may be provided to a downhole environment via production tubing 110 or other suitable means depending on the particular nature of operations. In the embodiment shown, a portion of a toolstring 180 emerges from a portion of the tubing 110 for use in carrying out any of a variety of downhole applications as detailed below.

Continuing with reference to FIG. 1, the multi-stage valve actuator 100 is coupled to a valve 175 for actuation thereof. In the embodiments described herein, the valve 175 is a formation isolation valve. Thus, with the valve 175 closed, fluid loss control may be exhibited in terms of avoiding leakage of comparatively heavy completions fluids into a downhole formation. Similarly, well control may be exhibited in terms of preventing premature production of comparatively lighter fluids from the formation. Of course, other types of valves may be actuated as described herein.

The actuator 100 of FIG. 1 includes a primary 125 and secondary 150 actuation mechanisms, both equipped with the capacity for valve actuation. For example, as detailed herein below, the secondary mechanism 150 may serve as a 'fail-safe' mode of actuation that is initially pressure activated for release. This may take place in advance of a higher pressure activation of the primary mechanism 125 which is configured as the primary means for opening the valve 175. However, should activation of the primary mechanism 125 fail in shifting open the valve 175, subsequent shifting of the previously released secondary, or 'fail-safe,' mechanism 150 may naturally occur, thereby serving to open the valve 175.

Figure 2A:
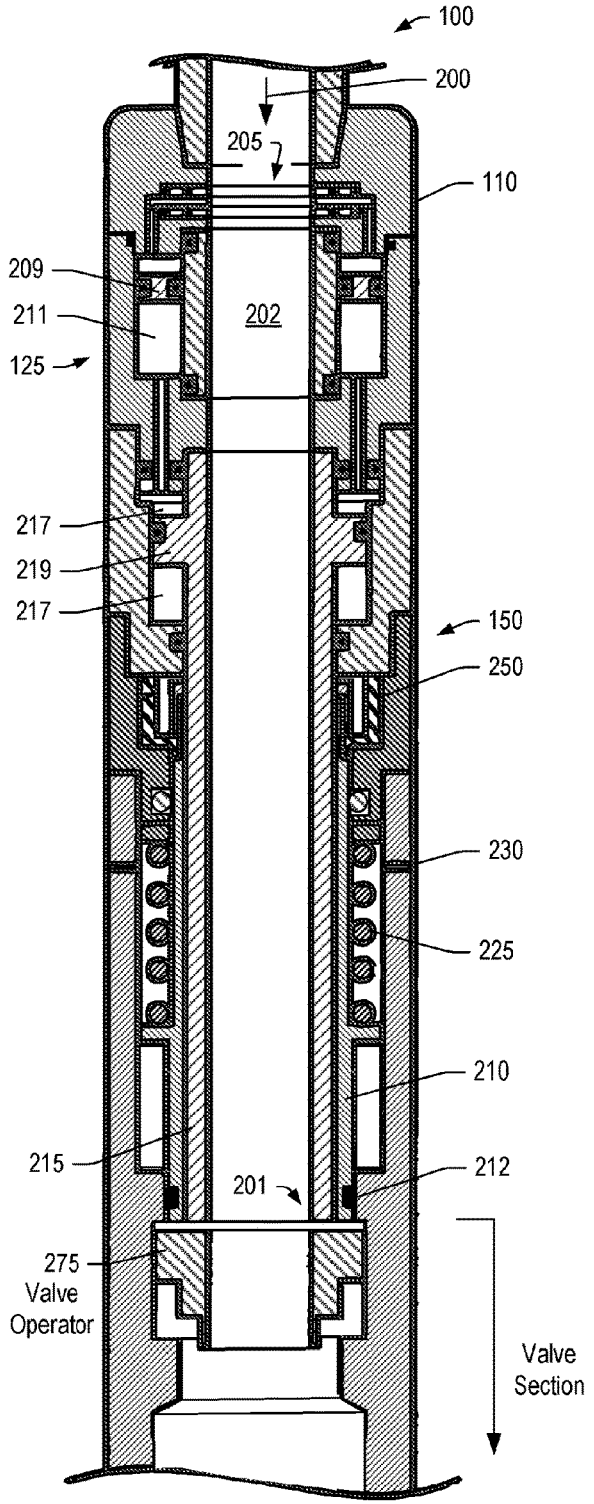
FIG. 2A is a side cross-sectional view of the actuator of FIG. 1 revealing a tension member release mandrel thereof and a rupture disc release mandrel thereof.
Figure 2B:
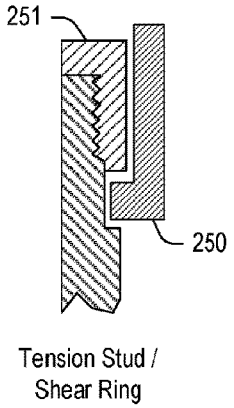
FIG. 2B is a side cross-sectional view of a tension stud and shear ring.
Figure 2C:
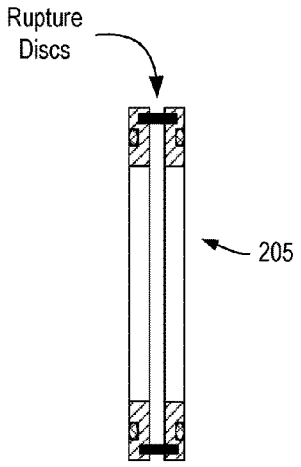
FIG. 2C is a schematic view of the actuator of a rupture disc.

Referring now to FIG. 2A, a side cross-sectional view of the actuator 100 of FIG. 1 is depicted while FIG. 2B shows a tension stud and a shear ring and FIG. 2C shows a rupture disc. More specifically, FIG. 2A reveals internal components of the fail-safe mechanism 150 and reveals internal components of the primary mechanism 125. For sake of illustration, the mechanisms 125, 150 are depicted as discrete units in FIG. 1. The mechanisms 125, 150 may share the same housing and internal fluid communication channel 202. Similarly, while depicted with the primary mechanism 125 downhole of the secondary mechanism 150, different types of orientations may be utilized.

Continuing with more specific reference to FIG. 2A, the secondary mechanism 150 includes an internal release mandrel 210. This mandrel 210 may be circumferential, perhaps of a collet variety, and is configured for shifting in the direction of an operator element 275. So, for example, where the mandrel 210 shifts to the right, in the depiction shown, the element 275 may correspondingly shift to the right so as to open a valve 175 as noted above. Indeed, as detailed further below, this 'fail-safe' mandrel 210 of the secondary mechanism 150 is configured to achieve this function in circumstances where the primary mechanism 125 and its corresponding mandrel 215 are unable to shift open the element 275.

In order to serve as a 'fail-safe' or backup mode of actuation, the release mandrel 210 of the secondary mechanism 150 is structurally released from body of the actuator 100. That is, as shown, the mandrel 210 is initially secured and immobilized to the body by a tension member 250, which may be disposed between a portion of the mandrel 210 and, for example, a fitting 251. However, with the valve 175 of FIG. 1 in a closed position, pressure within the channel 202 may be driven up by fluid flow 200 as directed from an oilfield surface 401 (see FIG. 4). For example, in one embodiment, a pressure differential of 1,000 PSI to 3,000 PSI may be imparted on the channel 202.

The above noted increasing pressure may be imparted on locations such as the gap 201 adjacent the mandrel 210 until sufficient force for breaking the tension member 250 is achieved. The increasing pressure via the flow 200 imparts a differential as compared to external pressure at the outer side of the mandrel 210, via an annulus port 230 in the embodiment shown. Additionally, the amount of force imparted by this differential sufficient for breaking the tension member 250 is a matter of operator choice. So, for example, an operator may employ a 250-500 lb. rated tension member 250 to be sheared upon exposure to the noted 1,000-3,000 PSI differential referenced above. Of course, alternate shear ratings corresponding to a variety of different pressure differentials may also be utilized.

With breakage of the tension member 250, the mandrel 210 may slidably shift to the left in the depiction shown. Note the presence of a seal 212 and a biasing spring 225 on the mandrel 210 for controllably governing this leftward shifting. In this manner, the mandrel 210 has been released relative the body of the actuator 100. That is to say, as opposed to an immediate shift to the right for movement of the operator element 275, the mandrel 210 may be shifted leftward for release and held in place by maintaining the pressure differential within the channel 202. Thus, as detailed further below, the mandrel 210 may be held in reserve to serve as a fail-safe mode of shifting the operator element 275 should the primary mechanism 125 detailed below fail to achieve this rightward shift.

As shown in FIG. 2A, the internal components of the primary mechanism 125 of the actuator 100 are described in added detail. Namely, this mechanism 125 includes an active mandrel 215 that is more directly responsive to pressurization through the channel 202. However, unlike the release mandrel 210, the active mandrel 215 is not initially shifted away from or held in reserve relative the operator element 275 of the valve 175. Rather, the influx of pressure via flow 200 may be imparted on a rupture disc 205 exposed to the channel 202 which ultimately serves to directly drive this mandrel 215 downhole toward the element 275.

In one embodiment, the pressure sufficient for rupturing the disc 205 and driving the mandrel 210 downhole is in excess of about 3,000 PSI. That is, the pressure sufficient for driving the primary mechanism 125 is substantially in excess of the pressure sufficient for achieving release of the release mandrel 210 of the secondary mechanism 150. As a practical matter, this means that as pressurized flow 200 is increased, the 'fail-safe' mandrel 210 is released by imparting an initial pressure. Subsequently, pressure is increased and this mandrel 210 is effectively held in place (or shifted slightly further uphole) as actuation of the active mandrel 215 proceeds. However, in circumstances where actuation of the active mandrel 215 fails, for example, due to failure of increased pressurization as described below, the fail-safe mandrel 210 may be subsequently employed for shifting of the operator element 275.

With particular reference to the shifting of the active mandrel 215, the rupturing of the disc 205 may lead to an influx of pressure acting on a compensating piston 209. This piston 209 may sealably float in an atmospheric oil chamber 211. Thus, the increase in pressure applied to the piston 209 imparts a differential that ultimately drives a head 219 of the mandrel 215 in the downhole direction toward the operator element 275.

Continuing with reference to FIG. 2A, it is worth noting that the fail-safe mechanism 150 differs from the primary mechanism 125 in that pressurized release of its internal mandrel 210 does not immediately or directly translate into downward shifting thereof. Alternatively, the primary mechanism 125 is configured to more directly shift its internal mandrel 215 in response to an influx of pressure. As detailed further below, this distinction between the interworkings of these two cooperating mechanisms 125, 150 is significant. Indeed, this distinction may be utilized to substantially eliminate the possibility of pressure based actuator failure resulting from the simultaneous use of multiple actuators 100, 300 in a single well 380 (see FIG. 3).

Figure 2D:
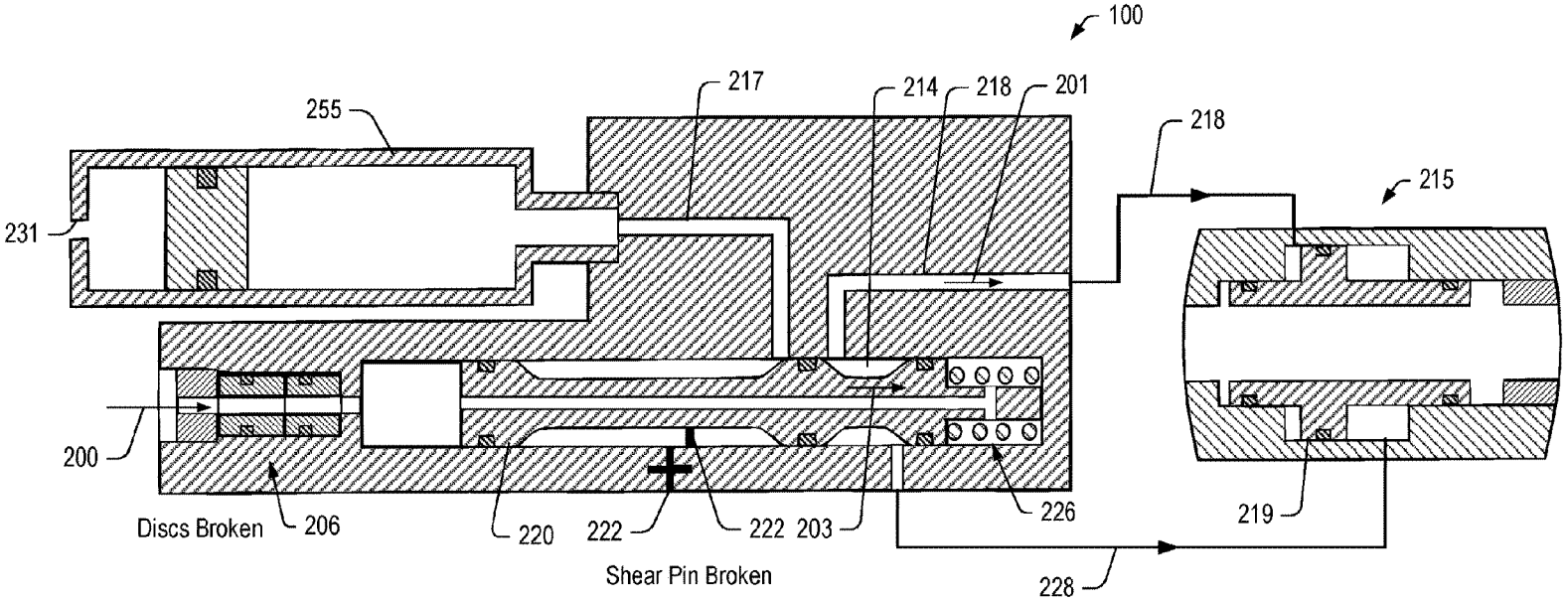
FIG. 2D is a schematic view of the actuator of FIG. 1 revealing an alternate configuration for a tension member release mandrel and technique.
Figure 2E:
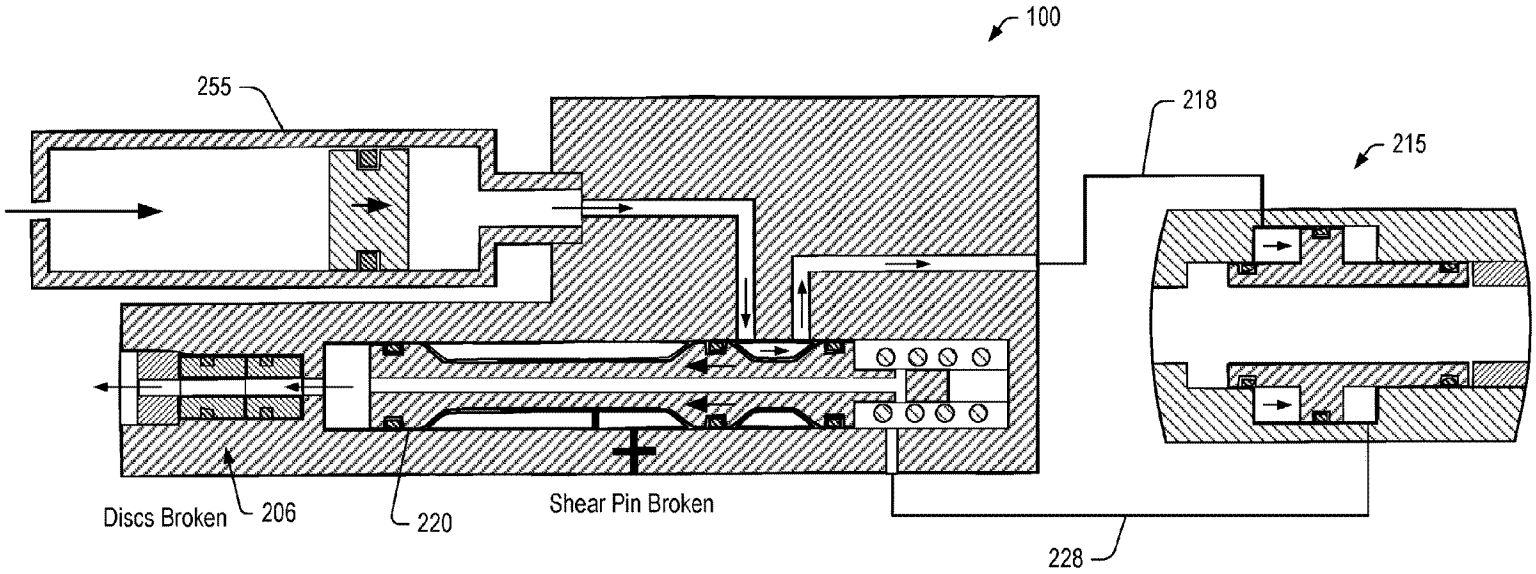
FIG. 2E is a schematic view of the actuator of FIG. 2D.

With particular reference to FIGS. 2D and 2E schematic views of the actuator 100 are depicted. However, in this case, an alternate or supplemental configuration for the fail-safe actuation mechanism is depicted. Namely, the release mandrel 220 is a hydraulic piston that governs fluid drive directed at the active mandrel 215. However, as in the case of the release mandrel 210 of FIG. 2A, the mandrel 220 of FIG. 2D is initially retained by a tensile member, in this case a shear pin 222, relative a housing of the actuator 100. As with the fail-safe mechanism 150 of FIG. 2A, the release mandrel 220 and technique of FIG. 2D again differs from the primary mechanism 125 in that the pressurized release of the mandrel 220 does not immediately or directly translate into a downward shift. Rather, it is in the event of potential lowering of pressure directed at the mandrel 220 that it is allowed to shift and ultimately direct active mandrel 215 actuation.

Continuing with reference to FIG. 2D, the release mandrel 220 is shown just as fluid flow 200 sufficient for pressure induced breakage of a rupture disc 206 is achieved. Thus, with sufficient fluid pressure, perhaps 1,000 PSI to 3,000 PSI, the noted shear pin 222 is broken and the mandrel 220 is forced to the right (arrow 203) (e.g., pressure is applied, a disc or discs burst, a pin sheared and a mandrel moves). Once more, while the pressure forces the mandrel 220 to the right, it is also biased against an adjacent spring 226. As shown, this results in the mandrel 220 occupying a position that prevents communication between hydrostatic 217 and driving 218 lines of the mechanism noting that a line 228 is also in fluid communication with the active mandrel 215. As shown in FIG. 2E, pressure is bled off and the spring 226 pushes the mandrel 220 to the left to establish fluid communication to the chamber.

Figure 3:
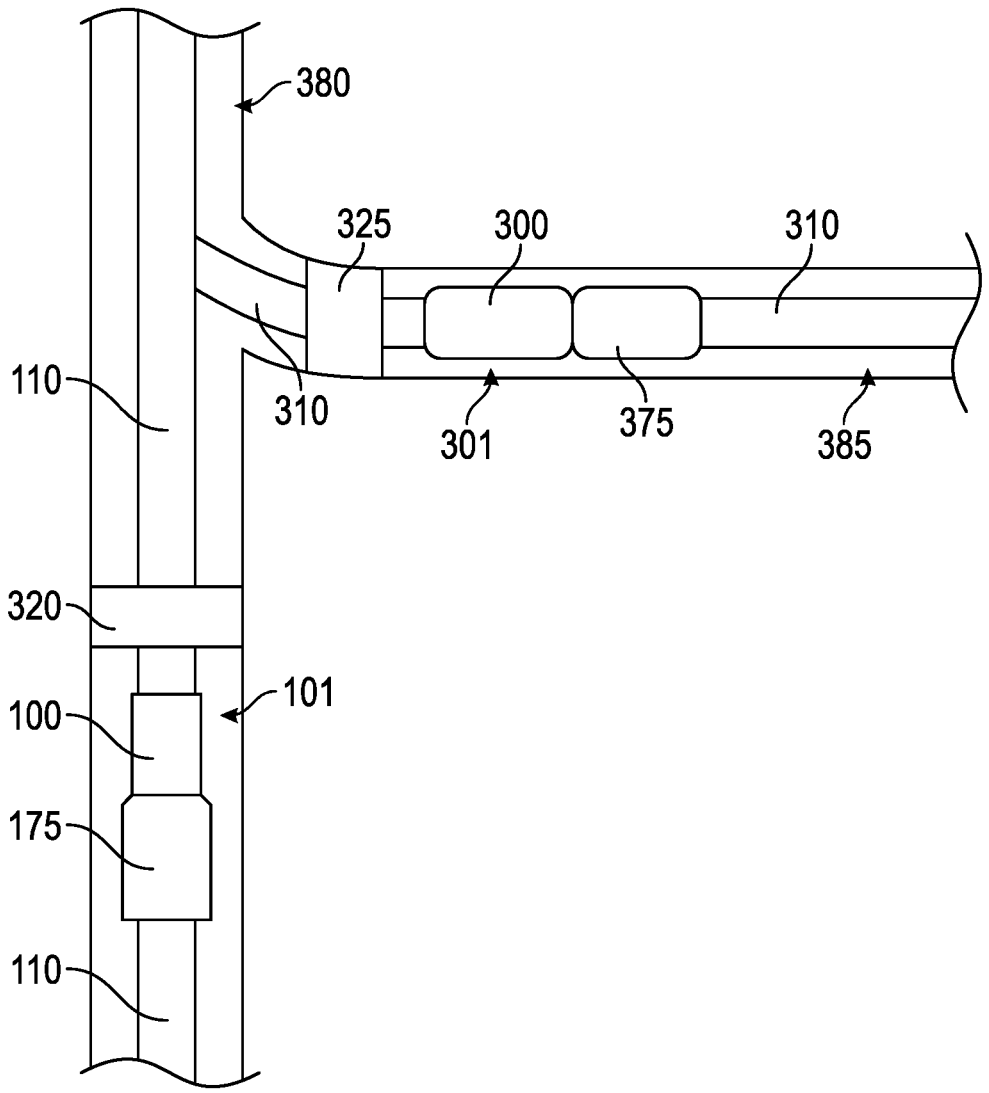
FIG. 3 is a schematic representing a well accommodating multiple actuator embodiments in multiple pressurizable legs thereof.
Figure 4:
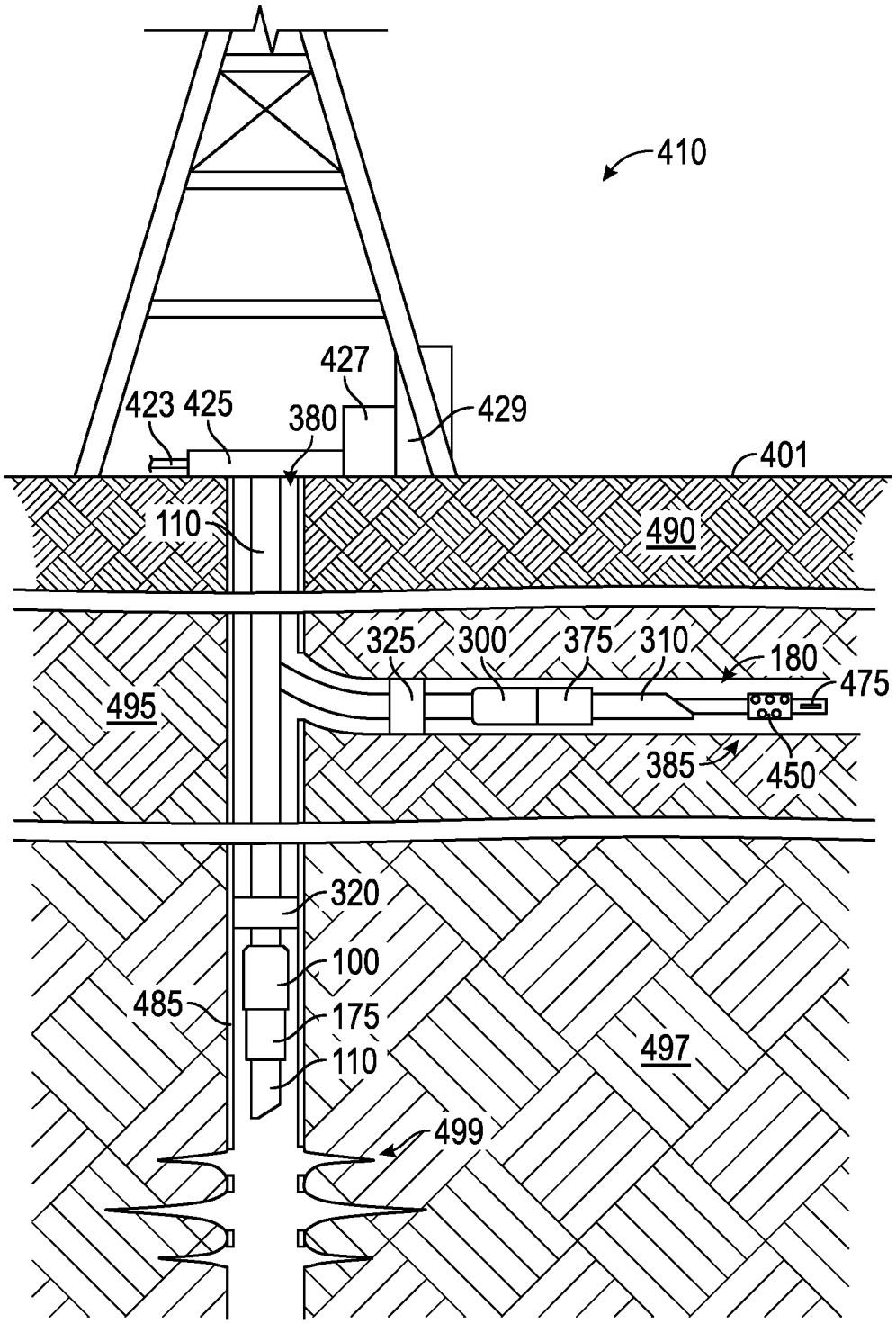
FIG. 4 is an overview of an oilfield with the multilateral well of FIG. 3 accommodating tool interventions and the multiple actuator embodiments therein.

With added reference to FIGS. 3 and 4, the mechanism of FIG. 2D includes a compensating piston 255 that is exposed to downhole pressure through an annular port 231. However, pressures of the well 380 are of no particular significance to the mechanism so long as the hydrostatic line 217 running from the piston 255 terminates at an occluded region of the mandrel 220. However, pressure from the flow 200 may be reduced as directed form surface or as a result of an open formation isolation valve in another branch of the well 380. Thus, this mandrel 220 may be shifted left by the spring 226 such that a communication bridge 214 between the lines 217, 218 is provided. As a result, internal flow 201 may be provided sufficient to drive a head 219 of the active mandrel 215 toward the operator element 275 (see FIG. 2A). Therefore, another fail-safe mechanism for activation is provided.

Referring now to FIG. 3, a schematic is shown representing a well 380 accommodating multiple actuators 100, 300. The actuators 100, 300 are disposed at multiple well branches, namely within the main bore and at a lateral leg 385 of the well 380. Once more, as in FIG. 1, the actuators 100, 300 are provided as part of larger overall production assemblies 101, 301 that are isolated by packers 320, 325. However, the production tubing 110 through the main bore is in fluid communication with a lateral tubing extension 310. Thus, with added reference to FIG. 2A, the influx of fluid 200 directed pressurization, for directing the actuators 100, 300 to act on their corresponding valves 175, 375, is shared. Stated another way, a single pressurization directed from surface 401 may be simultaneously directed at both assemblies 101, 301 (see FIG. 4).

With fluid flow 200 directing both valves 175, 375 to simultaneously open an initial risk is presented that only one valve 175, 375 is opened. So, for example, with particular reference to FIG. 2A, a premature rupturing of a disc 205 at one of the actuators 300 may lead to a premature opening of the corresponding valve 375. Thus, continued increasing of pressure for activating the other actuator 100 and opening its corresponding valve 175 may become impossible. That is, increasing fluid flow 200 through the system may end up only dumping fluid through the open valve 375 without further driving up pressure to effect the other actuator 300.

Fortunately, however, in the above described circumstance, the fail-safe mechanism 150 of FIG. 2A has already been activated at a notably lower pressure. More specifically, a previously freed release mandrel 210 is available for driving open the remaining closed valve 175. Indeed, pressure of the system may drop as a matter of operator direction or even inherently due to the noted open valve 375. Regardless, the drop in pressure allows this fail-safe mandrel 210 to shift downhole, as forced by spring 225 or other suitable means. As such, the opening of one valve 375 is not a substantial deterrent to the opening of another 175 even where opening is to be achieved in a pressure-based, interventionless manner.

Referring now to FIG. 4, an overview of an oilfield 401 is depicted which includes the multilateral well 380 of FIG. 3. The well 380 in turn accommodates a toolstring 180 along with multiple actuators 100, 300 and corresponding valves 175, 375 as detailed above. Thus, applications such as gravel packing and others may be directed by surface equipment 410 and proceed at isolated locations of the main bore or within a side leg 385. Indeed, added isolation may be provided by closure of valves 175, 375 in conjunction with removal of a toolstring 180 via production tubing 110, 310. More specifically, following an application, an interventional element 450 of the toolstring 180 may be withdrawn in conjunction with a shifting device 475. Thus, as shown, production tubing 110, 310 may traverse annularly isolated regions (e.g. 385, 499) as a result of packers 320, 325 and be further isolated due to the noted closure of valves 175, 375. So, for example, operations such as installation of hardware and other completions tasks may be performed further uphole without concern over fluid breaches into or from locations downhole of the valves 175, 375 and packers 320, 325.

Continuing with reference to FIG. 4, the multilateral well 380 safely traverses various formation layers 490, 495, 497 in a cased 485 and isolated manner as indicated. Thus, ultimately, production may be achieved from an open-hole lateral leg 385 or a perforated region 499 as depicted. Such production and/or prior completions tasks as noted above may be regulated and aided by surface equipment 410 disposed at the surface of the oilfield 401. In the embodiment shown, this equipment includes a conventional well head 425 with production line 423 therefrom. Additionally, a pump mechanism 427 and operator control unit 429 are also depicted adjacent the well head 425 for directing downhole operations. These may include the pressure based maneuvers of the actuators 100, 300 as detailed hereinabove, interventional applications via the toolstring 180 or a host of other applications.

Regardless of the particular applications, they may proceed in a securely isolated fashion once the valves 175, 375 are closed. Further, opening of the valves 175, 375 may take place in a pressure based internventionless manner even in circumstances where sequential opening thereof occurs. That is, as detailed above, the actuator 100, 300 for each valve 175, 375 is equipped with a 'fail-safe' mechanism 150 to allow a given valve 175 to open even in circumstances where the other valve 375 has previously opened, whether prematurely or otherwise.

Figure 5C:
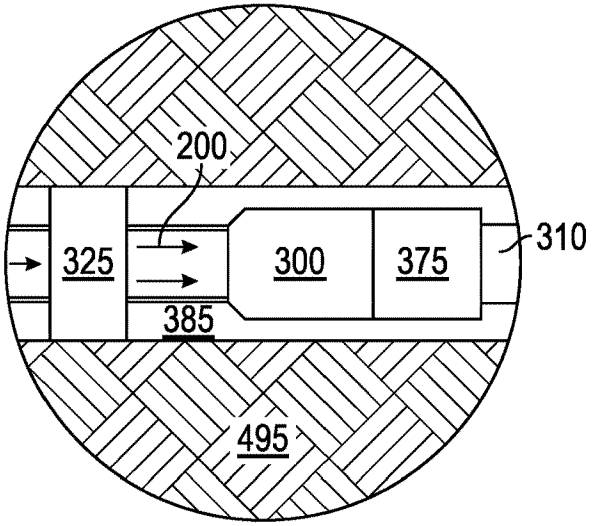
FIG. 5C is an enlarged view of the leg of FIG. 5B with the valve reopened via a pressurization technique applied to the actuator.
Figure 5B:
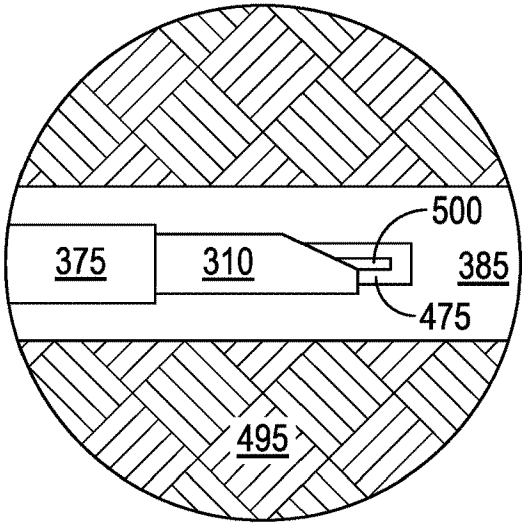
FIG. 5B is an enlarged view of the leg and actuator of FIG. 5A pressurizably sealed off by a valve closure and tool retrieval maneuver.
Figure 5A:
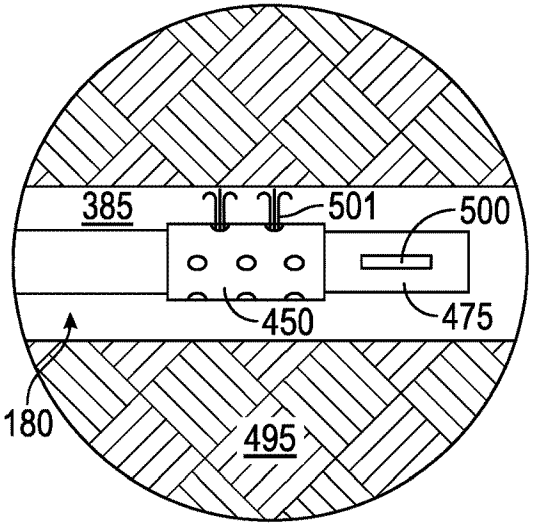
FIG. 5A is an enlarged view of a leg of the well of FIG. 4 accommodating an actuator in conjunction with an interventional application therein.

Referring now to FIGS. 5A-5C, enlarged views of an application in the lateral leg 385 are depicted by way of the interventional element 450, the actuator 375 and other system components. More specifically, FIG. 5A depicts an enlarged view of the toolstring 180 directing the interventional element 450 to a location in the lateral leg 385 for a fluid based cleanout 501 thereat. Of course, a variety of different applications, such as the indicated gravel packing, may be carried out through such an element 450. Additionally, note that the element 450 structurally accommodates the shifting device 475 for later use as described below.

With specific reference to FIG. 5B, an enlarged view of the leg 385 is shown following the above referenced cleanout application. Thus, the toolstring 180 of FIG. 5A may now be withdrawn through the extension of production tubing 310 as depicted. Once more, the indicated shifting device 475 is outfitted with a key 500 having a matching profile for interfacing and sealably closing the valve 375 as it is withdrawn through the interior of the system.

With the valve 375 now serving as a closed off formation isolation valve, uphole operations such as completions installation may proceed as detailed hereinabove. Indeed, with added reference to FIG. 4, both the lateral leg 385 and the main bore of the well 380 may be closed off in this manner to allow for such completions to safely proceed. However, with added reference to FIG. 5C, once production is sought through the lateral leg 385, the valve 375 may be opened in a pressure based interventionless manner. More specifically, FIG. 5C reveals an influx of fluid 200 for pressure driven opening of the valve 375 by way of the actuator 300 as detailed hereinabove. Once more, even in circumstances where driving up this pressure at the actuator 300 in synchronization with pressure at another actuator (e.g. 100 in FIG. 3) is compromised, a fail-safe technique and mechanism 250 are provided so as to ensure opening of the valve 375 (see FIG. 2A).

Figure 6:
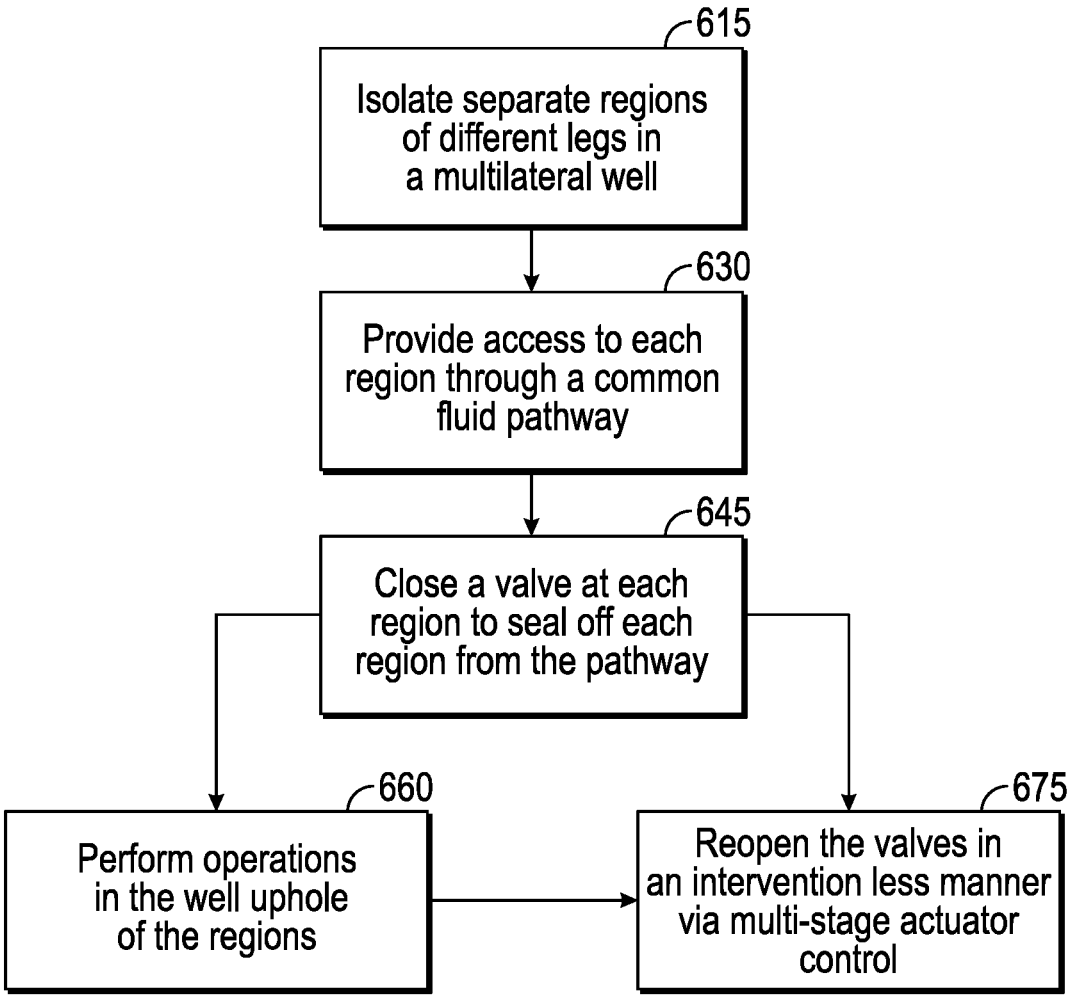
FIG. 6 is a flow-chart summarizing an embodiment of employing at least one multi-stage valve actuator.

Referring now to FIG. 6, a flow-chart summarizing an embodiment of employing at least one multi-stage valve actuator, with primary stage and secondary or 'fail-safe' stage mechanisms is depicted. That is, separate regions of different multilateral well legs may be isolated as indicated at 615. Thus, as noted at 630, a common fluid pathway may be provided relative to each region. As such, interventionless reopening of valves at the regions may ultimately take place via the pathway as described above and indicated further below.

Regardless, with valves at each region closed as noted at 645, operations may safely be performed at locations further uphole as noted at 660. Thus, even though interventionless opening of each valve is achieved through the common pathway, the availability of a multi-stage actuator to control each valve helps ensure that each is properly opened as indicated at 675. As detailed hereinabove, this is achieved by way of multi-stage pressurization of secondary 'fail-safe' and primary actuator mechanisms. Once more, in one embodiment, the primary mechanism may be aided by a supplemental actuation mechanism in the form of a conventional electric trigger in lieu of or in addition to the released secondary mechanism. For example, even though pressurization for shifting the primary mechanism may be insufficient, a pressure pulse or other suitable signaling technique may be employed to set off the trigger for driving of the primary mechanism.

Embodiments described hereinabove include tools and techniques which help avoid the need for reintroduction of an interventional shifting tool to re-open valves such as formation isolation valves. These tools and techniques are even effective in circumstances where conventional pressure directed interventionless control is compromised due to premature or unintended sequential valve openings in wells of multilateral architecture. As a result, countless hours and significant operational expenses may be spared.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Regardless, the foregoing description should not be read as pertaining only to the precise structures described and shown in the accompanying drawings, but rather should be read as consistent with and as support for the following claims, which are to have their fullest and fairest scope.

I claim:

1. A multi-stage valve actuator for disposing in a multilateral well and comprising:

a primary actuation mechanism for driving open an operator element of a valve adjacent thereto, wherein the primary actuation mechanism comprises:

an active mandrel disposed in the housing; and a rupture disc hydraulic assembly for activating the active mandrel for the driving upon exposure to a predetermined level of hydraulic pressure, wherein the rupture disc hydraulic assembly comprises a compensator piston; and a fail-safe actuation mechanism for releasing from a housing of the actuator to open the operator element upon failure of the driving.

2. The actuator of claim 1 wherein said fail-safe actuation mechanism comprises:

a release mandrel; and a shearable member for structurally securing said release mandrel to the housing in advance of the releasing upon exposure to a given level of hydraulic pressure.

3. The actuator of claim 2 wherein the predetermined level of hydraulic pressure for driving the primary actuation mechanism is greater than the given level of hydraulic pressure for releasing the release mandrel.

4. The actuator of claim 2, wherein the release mandrel comprises at least one of a seal and a biasing spring.

5. The actuator of claim 2, wherein the release mandrel does not immediately shift to open the operator element upon release.

6. The actuator of claim 1 further comprising a supplemental actuation mechanism coupled to said primary actuation mechanism to aid the driving.

7. The actuator of claim 6 wherein said supplemental actuation mechanism is an electronically triggered mechanism.

8. The actuator of claim 1, wherein the valve is a formation isolation valve.

9. The actuator of claim 1, wherein the predetermined level of hydraulic pressure is in excess of about 3,000 PSI.

* * * * *